US012063969B2

(12) United States Patent
Lee

(10) Patent No.: US 12,063,969 B2
(45) Date of Patent: Aug. 20, 2024

(54) HEATING ASSEMBLY, AEROSOL-GENERATING DEVICE INCLUDING THE SAME, AND AEROSOL-GENERATING SYSTEM INCLUDING THE SAME

(71) Applicant: KT&G CORPORATION, Daejeon (KR)

(72) Inventor: Seung Won Lee, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 780 days.

(21) Appl. No.: 17/253,453

(22) PCT Filed: Jul. 29, 2020

(86) PCT No.: PCT/KR2020/010015
§ 371 (c)(1),
(2) Date: Dec. 17, 2020

(87) PCT Pub. No.: WO2021/025367
PCT Pub. Date: Feb. 11, 2021

(65) Prior Publication Data

US 2022/0304387 A1 Sep. 29, 2022

(30) Foreign Application Priority Data

Aug. 2, 2019 (KR) ..... 10-2019-0094531

(51) Int. Cl.
*A24F 40/465* (2020.01)
*A24F 40/50* (2020.01)

(52) U.S. Cl.
CPC ..... *A24F 40/465* (2020.01); *A24F 40/50* (2020.01)

(58) Field of Classification Search
CPC ..... A24F 40/465; A24F 40/50; A24F 40/46; A24F 40/20; H05B 2203/002; H05B 6/105; H05B 3/46; H05B 6/36
USPC ..... 131/328
See application file for complete search history.

(56) References Cited

U.S. PATENT DOCUMENTS

| | | | | |
|---|---|---|---|---|
| 9,657,992 | B2 * | 5/2017 | Steinlage | H01F 5/02 |
| 2016/0143092 | A1 * | 5/2016 | Miller | C22C 38/08 219/634 |
| 2016/0150825 | A1 * | 6/2016 | Mironov | A24F 40/46 219/634 |
| 2017/0055580 | A1 * | 3/2017 | Blandino | H05B 6/108 |

(Continued)

FOREIGN PATENT DOCUMENTS

| | | | |
|---|---|---|---|
| CA | 3076886 | A1 | 5/2019 |
| CN | 207040896 | U | 2/2018 |

(Continued)

OTHER PUBLICATIONS

Chinese Office Action dated Apr. 21, 2023 in Chinese Application No. 202080004883.7.

(Continued)

*Primary Examiner* — Alexander Gilman
(74) *Attorney, Agent, or Firm* — Sughrue Mion, PLLC

(57) ABSTRACT

The present invention provides a heating assembly for an aerosol-generating device including an induction-heating first heating element and a resistance-heating second heating element, which are individually controlled according to the operating mode of the aerosol-generating device.

12 Claims, 6 Drawing Sheets

(56) References Cited

U.S. PATENT DOCUMENTS

| | | | | |
|---|---|---|---|---|
| 2017/0119047 | A1* | 5/2017 | Blandino | A24C 5/01 |
| 2017/0119048 | A1* | 5/2017 | Kaufman | H05B 6/105 |
| 2017/0119049 | A1* | 5/2017 | Blandino | A24D 1/042 |
| 2017/0340003 | A1* | 11/2017 | Batista | A24F 40/46 |
| 2018/0007974 | A1* | 1/2018 | Thorens | A24F 40/40 |
| 2018/0029782 | A1 | 2/2018 | Zuber et al. | |
| 2018/0184713 | A1* | 7/2018 | Mironov | A24F 40/30 |
| 2018/0192700 | A1* | 7/2018 | Fraser | A24F 40/44 |
| 2018/0325179 | A1* | 11/2018 | Li | H05B 1/0252 |
| 2019/0124987 | A1 | 5/2019 | Wu et al. | |
| 2019/0182909 | A1 | 6/2019 | Fursa et al. | |
| 2019/0230987 | A1* | 8/2019 | Wu | H05B 6/36 |
| 2019/0380390 | A1* | 12/2019 | Jeong | A24F 40/46 |
| 2020/0060351 | A1 | 2/2020 | Thorens | |
| 2020/0221773 | A1* | 7/2020 | An | A24F 40/51 |
| 2020/0281273 | A1 | 9/2020 | Kim et al. | |
| 2022/0167678 | A1 | 6/2022 | Warren et al. | |

FOREIGN PATENT DOCUMENTS

| | | | |
|---|---|---|---|
| CN | 208692322 | U | 4/2019 |
| EP | 3357359 | A2 | 8/2018 |
| GB | 201903308 | | 4/2019 |
| KR | 10-2019-0013716 | A | 2/2019 |
| KR | 10-2019-0028718 | A | 3/2019 |
| WO | 2009/012239 | A2 | 1/2009 |
| WO | 2017/207415 | A1 | 12/2017 |
| WO | 2018/135888 | A1 | 7/2018 |
| WO | 2019/016737 | A1 | 1/2019 |
| WO | 2019/088588 | A2 | 5/2019 |
| WO | 2021/116994 | A1 | 6/2021 |

OTHER PUBLICATIONS

International Search Report for PCT/KR2020/010015 dated, Nov. 5, 2020 (PCT/ISA/210).

Written Opinion of the International Searching Authority for PCT/KR2020/010015 dated, Nov. 5, 2020.

Office Action issued Mar. 29, 2022 in Japanese Application No. 2021-506628.

Chinese Office Action issued Sep. 27, 2023 in Application No. 202080004883.7.

Extended European Search Reported issued Nov. 17, 2021 in EP Application No. 20824410.3.

* cited by examiner

HEATING ASSEMBLY, AEROSOL-GENERATING DEVICE INCLUDING THE SAME, AND AEROSOL-GENERATING SYSTEM INCLUDING THE SAME

CROSS REFERENCE TO RELATED APPLICATIONS

This application is a National Stage of International Application No. PCT/KR2020/010015 filed Jul. 29, 2020, claiming priority based on Korean Application No. 10-2019-0094531 filed on Aug. 2, 2019.

TECHNICAL FIELD

The present invention provides a heating assembly for an aerosol-generating device including both an induction-heating first heating element and a resistance-heating second heating element, an aerosol-generating device including the same, and an aerosol-generating system including the aerosol-generating device.

BACKGROUND ART

Recently, the demand for alternatives to traditional combustive cigarettes has increased. For example, there is growing demand for aerosol-generating devices that generates aerosol by heating an aerosol generating material in cigarettes, rather than by combusting cigarettes. Accordingly, studies on a heating-type cigarette and a heating-type aerosol generating device have been actively conducted.

Conventional aerosol-generating devices have mainly used electric resistance-heating devices to heat cigarettes, but recently, the number of products using induction-heating devices including a susceptor that generates heat by an induction coil is increasing.

DISCLOSURE

Technical Solution

Existing aerosol-generating devices use either electric resistance heating or induction heating, and are incapable of controlling a type and number of operating heating elements. As a result, the heating efficiency is relatively poor.

A technical problem is not limited to the above, and other technical problems may be inferred from following examples.

Advantageous Effects

According to an embodiment, by properly combining an induction heating method with low power consumption and a resistance heating method with high heat generation, heating of the cigarette may be optimized for each operating mode of the aerosol-generating device.

In detail, when the first heating element and the second heating element are operated in a preheating mode of the aerosol-generating device, there is an advantage in that the time to reach a preset temperature in the preheating mode is shorter than the time to reach the preset temperature in a smoking mode in which only one of the first heating element and the second heating element is operated. Accordingly, by properly controlling the type and number of heating elements to be operated in each mode, the speed of preheating may be improved and power consumption of the aerosol-generating device may be reduced.

In another embodiment, when a first electrical insulating layer and a second heating element are positioned to cover a portion of a first heating element, a first heating element and the second heating element may be heated together. In this case, the second heating element may be positioned to heat a specific portion of a cigarette when the cigarette is inserted into a heating assembly. Therefore, it is possible to focus heating on a specific portion of the cigarette.

The effects of the present invention are not limited to the above, and may include other effects that may be inferred from the embodiments described below.

BEST MODE

Figure 1:
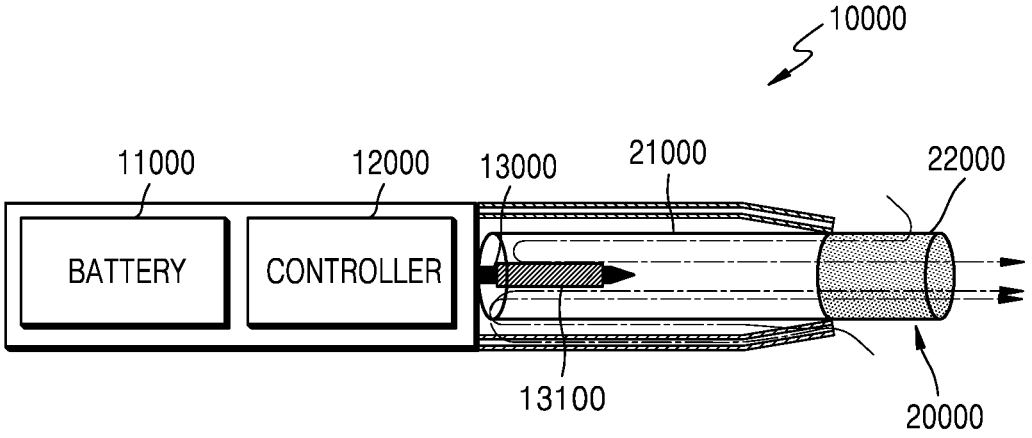
FIG. 1 is a view showing an example in which a cigarette is inserted into an aerosol-generating device.

The first aspect of the present invention, may provide a heating assembly for an aerosol-generating device including: a first heating element including a susceptor material configured to be heated by induction heating according to a variable magnetic field; a first electrical insulating layer that surrounds at least a portion of an outer surface of the first heating element; and a second heating element positioned on the first electrical insulating layer and configured to be heated by specific resistance as power is supplied.

In embodiments, the second heating element may include a conductive pattern, and the heating assembly may further include a second electrical insulating layer positioned on the conductive pattern.

In embodiments, the first electrical insulating layer and the second heating element may fully cover the entirety of the first heating element along a longitudinal direction of the first heating element, and the longitudinal direction of the first heating element may be a direction corresponding to a longitudinal direction of a cigarette or a direction in which the cigarette is inserted into the aerosol-generating device.

In embodiments, the first electrical insulating layer and the second heating element may partially cover the first heating element along the longitudinal direction of the first heating element, and the longitudinal direction of the first heating element may be a longitudinal direction of a cigarette or a direction in which the cigarette is inserted into the aerosol-generating device.

In embodiments, a cigarette to be inserted in the aerosol-generating device may include a first portion and a second portion which generate an aerosol when heated, the first heating element may overlap the first portion and the second portion of the cigarette in a radial direction of the cigarette, and the second heating element may overlap the first portion or the second portion of the cigarette in the radial direction of the cigarette.

In embodiments, a cigarette to be inserted in the aerosol-generating device may include a first portion and a second portion which generate an aerosol when heated, the first heating element may overlap the first portion and the second portion of the cigarette in a radial direction of the cigarette, and the second heating element may overlap the first portion of the cigarette in the radial direction of the cigarette.

Another aspect of the present invention may provide an aerosol-generating device including a heating assembly for an aerosol-generating device according to the first aspect, a coil inducing the variable magnetic field to heat the first heating element, a battery supplying power to the coil and the second heating element, and a controller controlling the power supplied by the battery to the coil and the second heating element.

In embodiments, the aerosol-generating device further includes a support for supporting the heating assembly, and the support includes a terminal for transmitting electric power from the battery to the second heating element on a support surface, and the aerosol-generating device may include an electrode positioned between the second heating element and the terminal, and the coil overlaps the first heating element and does not overlap the electrode, in a radial direction of the cigarette.

In embodiments, when the aerosol-generating device is in a preheating mode, the controller controls the battery to supply power to the second heating element and the coil, so as to heat the first heating element and the second heating element, and when the aerosol-generating device is in a smoking mode, the controller controls the battery to supply power to the coil or the second heating element, so as to heat only one of the first heating element and the second heating element.

Another aspect of the present invention may provide an aerosol-generating system including a cigarette including a first portion and a second portion which generate an aerosol when heated; and an aerosol-generating device including a heating assembly configured to heat the cigarette, wherein the heating assembly comprises: a first heating element including a susceptor material configured to be heated by induction heating according to a variable magnetic field; a first electrical insulating layer that surrounds at least a portion of an outer surface of the first heating element; and a second heating element positioned on the first electrical insulating layer and configured to be heated by specific resistance as power is supplied.

In embodiments, when the cigarette is inserted into the aerosol-generating device, the first heating element may overlap the first portion and the second portion of the cigarette in a radial direction of the cigarette, and the second heating element may overlap the first portion of the cigarette in the radial direction of the cigarette.

In embodiments, the aerosol-generating device may further include: a coil configured to induce the variable magnetic field to heat the first heating element; a battery configured to supply power to the heating assembly; and a controller configured to: when the aerosol-generating device is in a preheating mode, control the battery to supply power to the second heating element and the coil such that the first heating element and the second heating element are heated, and when the aerosol-generating device is in a smoking mode, the controller controls the battery to supply power to the coil or the second heating element such that only one of the first heating element and the second heating element is heated.

MODE FOR INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Throughout the specification, a "preheating mode" means an operating mode for heating the heating elements in advance before generating an aerosol.

Throughout the specification, a "smoking mode" means an operating mode for controlling the heating elements to be maintained at a temperature higher than or equal to the preset temperature of a preheating mode. However, the present invention is not limited thereto, and the "smoking mode" may follow any suitable temperature profile.

Throughout the specification, a "longitudinal direction of a heating assembly or a heating element" refers to a longitudinal direction of the cigarette or a direction in which the cigarette is inserted into the aerosol-generating device.

For example, a first heating element of the heating assembly which is to surround the cigarette accommodated in the aerosol-generating device has an elongated cylindrical shape, a height direction of the cylinder corresponds to the longitudinal direction of the heating assembly.

As another example, when the heating assembly includes a first heating element with a pointed rod shape which is to be inserted into a cigarette accommodated in the aerosol-generating device, a height direction of the pointed rod corresponds to the longitudinal direction of the heating assembly.

Hereinafter, embodiments of the present invention will be described in detail with reference to drawings.

FIG. 1 is a view showing an example in which a cigarette 20000 is inserted into an aerosol-generating device10000.

Referring to FIG. 1, the aerosol-generating device 10000 may include a battery 11000, a controller 12000, a first heating element 13000, and a second heating element 13100. The cigarette 20000 may be inserted into the internal space of the aerosol-generating device 10000.

The aerosol-generating device 10000 illustrated in FIG. 1 shows components related to the present embodiment. Therefore, it may be understood by those skilled in the art related to the present embodiment that other components in addition to those shown in FIG. 1 may be further included in the aerosol-generating device 10000.

In addition, FIG. 1 shows that the aerosol-generating device 10000 includes a first heating element 13000 and a second heating element 13100.

In FIG. 1, the battery 11000, the controller 12000, and the first heating element 13000 are arranged in a line, the second heating element 13100 is shown to cover a portion of the first heating element 13000 along the longitudinal direction of the first heating element 13000. When the cigarette 20000 is inserted, the first heating element 13000 and the second heating element 13100 may be inserted into the cigarette.

Figure 2:
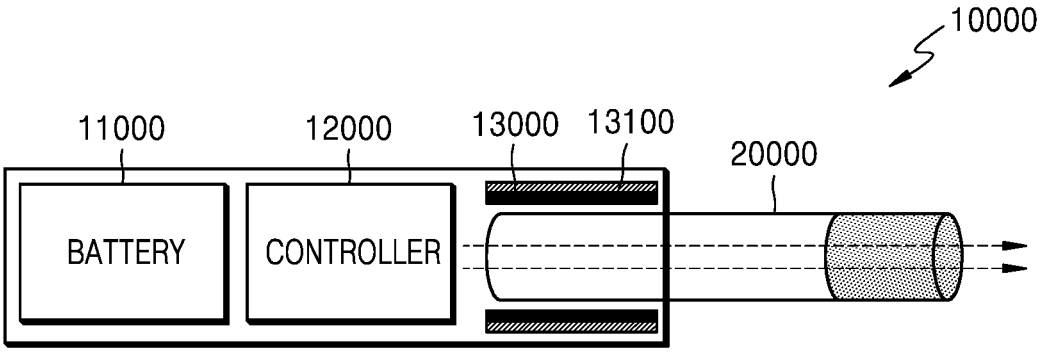
FIG. 2 is a view showing another example in which a cigarette is inserted into an aerosol-generating device.

Referring to FIG. 2, the battery 11000, the controller 12000, and the first heating element 13000 are arranged in a line. Also, the second heating element 13100 is shown to cover a portion of the first heating element 13000 along the longitudinal direction of the first heating element 13000. In FIG. 2, unlike the example shown in FIG. 1, when the cigarette 20000 is inserted, the first heating element 13000 and the second heating element 13100 are positioned to surround the cigarette from the outside.

The internal structure of the aerosol-generating device 10000 is not limited to that shown in FIGS. 1 and 2. In other words, according to the design of the aerosol-generating device 10000, the arrangements of the battery 11000, the controller 12000, the first heating element 13000, and the second heating element 13100 may be changed.

When the cigarette (20000) is inserted into the aerosol-generating device (10000), the first heating element 13000 and the second heating element 13100 are heated to generate an aerosol from the cigarette 20000, which will be described in detail below.

When the cigarette 20000 is inserted into the aerosol-generating device 10000, the aerosol-generating device 10000 may generate aerosol from the cigarette 20000 by operating at least one of the first heating element 13000 and the second heating element 13100. The aerosol generated by at least one of the first heating element 13000 and the second heating element 13100 may pass through the cigarette 20000 and may be delivered to a user.

If necessary, even if the cigarette 20000 is not inserted into the aerosol-generating device 10000, the aerosol-generating device 10000 may heat at least one of the first heating element 13000 and the second heating element 13100.

The battery 11000 supplies power used to operate the aerosol-generating device 10000. For example, the battery 11000 may supply power so that the first heating element 13000 and/or the second heating element 13100 may be heated, and supply power required for the controller 12000 to operate. In addition, the battery 11000 may supply power required for the display, sensor, and motor installed in the aerosol-generating device 10000 to operate.

The controller 12000 controls overall operations of the aerosol-generating device 10000. In detail, the controller 12000 may control not only an operation of the battery 11000, the first heating element 13000, and the second heating element 13100, but also an operation of other components included in the aerosol-generating device 10000. In addition, the controller 12000 may determine whether the components of the aerosol-generating device 10000 are in an operable state. Also, the controller 12000 may individually control the first heating element 13000 and the second heating element 13100. As such, one of the first heating element 13000 and the second heating element 13100 may or may not operate regardless of the operating status of the other.

The controller 12000 may include at least one processor. A processor can be implemented as an array of a plurality of logic gates or can be implemented as a combination of a microprocessor and a memory in which a program executable in the microprocessor is stored. It will be understood by one of ordinary skill in the art that the processor can be implemented in other forms of hardware.

The first heating element 13000 and the second heating element 13100 may be heated by electric power supplied from the battery 11000. For example, if the cigarette 20000 is inserted into the aerosol-generating device 10000, the first heating element 13000 and the second heating element 13100 may be positioned to surround the outside of the cigarette 20000 or may be inserted inside the cigarette 20000. Accordingly, as the first heating element 13000 and the second heating element 13100 are heated, a temperature of an aerosol-generating material in the cigarette 20000 may be increased.

Figure 4:
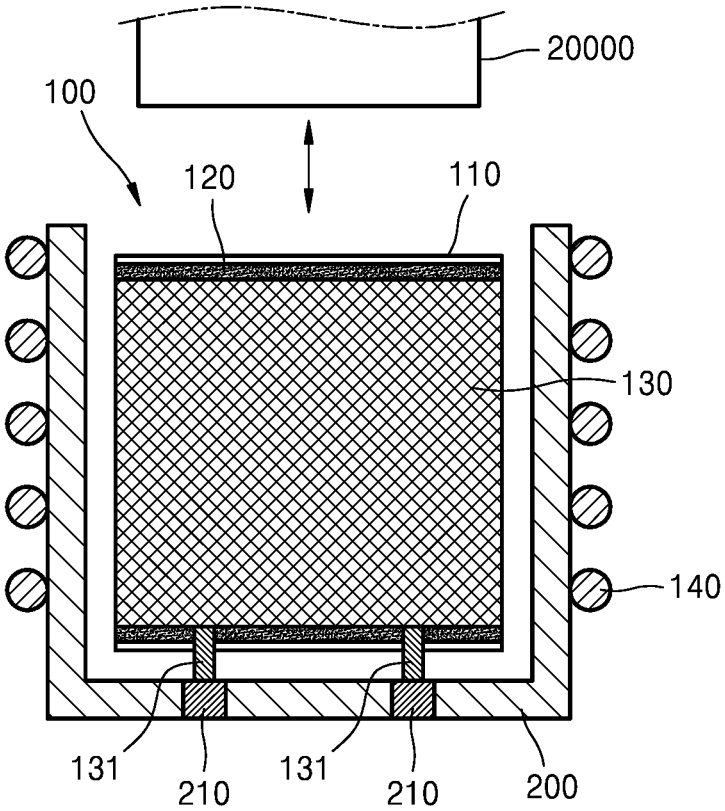
FIG. 4 is a cross-sectional view of a heating assembly for an aerosol-generating device according to an embodiment.
Figure 5:
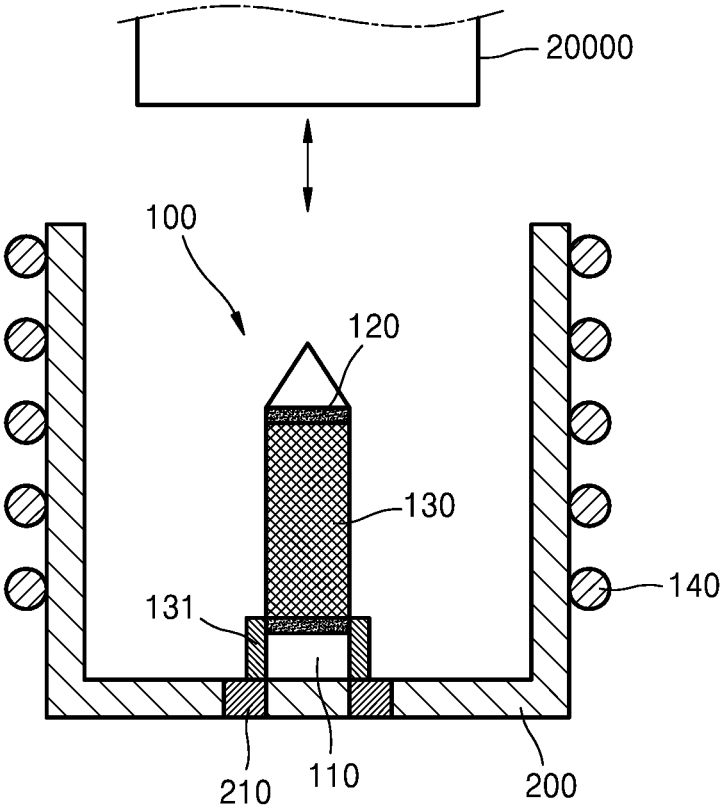
FIG. 5 is a cross-sectional view showing a heating assembly for an aerosol-generating device according to another embodiment.

The first heating element 13000 may be, for example, an induction heating-type heater. In detail, the first heating element 13000 may include a susceptor capable of heating the cigarette 20000 by an induction heating method. The susceptor may have, for example, a cylindrical shape as shown in FIG. 4, or a pointed rod shape as shown in FIG. 5. However, these are only examples, and the susceptor may have any other shape suitable for heating the cigarette 20000.

For example, the first heating element 13000 may include a tubular heating element, a plate heating element, a needle heating element, or a rod-shaped heating element, and heat the inside or outside of the cigarette 20000 depending on the shape of the heating element.

Meanwhile, the second heating element 13100 may be, for example, an electric resistive heater. For example, the second heating element 13100 may include an electrically conductive track or conductive pattern, and may be heated by supplying power to the electrically conductive track or conductive pattern. Since the second heating element 13100 is disposed on the inner circumferential surface or the outer circumferential surface of the first heating element 13000, the overall shape of the second heating element 13100 may be determined according to the shape of the first heating element 13000.

The first heating element 13000 and the second heating element 13100 are not limited to the above-described examples, and may be applied without limitation as long as they may be heated to a desired temperature. Here, the desired temperature may be preset in the aerosol-generating device 10000, or may be set by a user.

In addition, a plurality of heating elements may be disposed in the aerosol-generating device 10000. Here, the plurality of heating elements including the first heating element 13000 and the second heating element 13100 may be positioned to be inserted into the cigarette 20000, and/or may be disposed outside the cigarette 20000. For example, some of the plurality of heating elements may be positioned to be inserted into the inside of the cigarette 20000, and the rest may be disposed outside the cigarette 20000. In addition, the shapes of the heating elements are not limited to those shown in FIGS. 1 and 2, and may be manufactured in various shapes.

Meanwhile, the aerosol-generating device 10000 may further include other components in addition to the battery 11000, the controller 12000, the first heating element 13000, and the second heating element 13100. For example, the aerosol generating device 10000 may include a display capable of outputting visual information and/or a motor for outputting haptic information. Also, the aerosol generating device 10000 may include at least one sensor (e.g., a puff detecting sensor, a temperature detecting sensor, a cigarette insertion detecting sensor, etc.). Also, the aerosol generating device 10000 may have a structure that introduces external air or discharge internal air even when the cigarette 20000 is inserted into the aerosol generating device 10000.

Although not shown in FIGS. 1 and 2, the aerosol-generating device 10000 may constitute a system with a separate cradle. For example, the cradle may be used to charge the battery 11000 of the aerosol-generating device 10000. For example, at least one of the first heating element 13000 and the second heating element 13100 may be heated while the cradle and the aerosol-generating device 10000 are combined.

For example, the structure of the cigarette 20000 may have a similar structure to a general combustion-type cigarette. The cigarette may include a shredded tobacco portion, a filter portion, and the like. According to an embodiment, a general combustion type cigarette may be inserted in the aerosol-generating device 10000.

Figure 3:
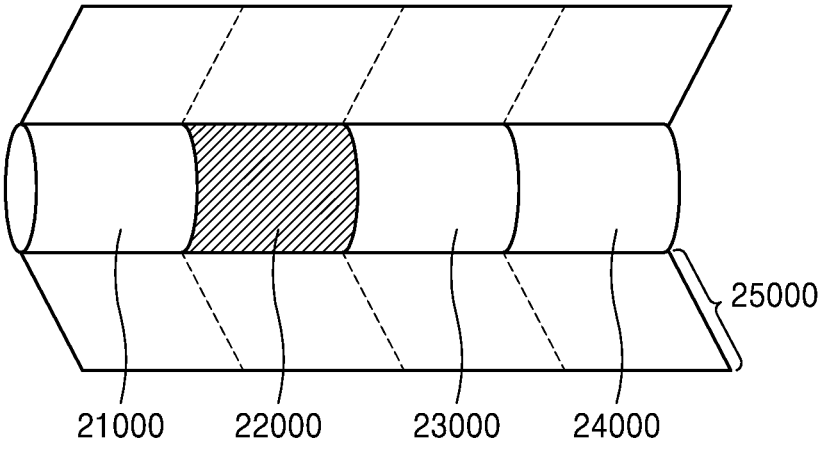
FIG. 3 is a view showing an example of a cigarette including at least one aerosol generating unit.

Unlike the general combustion type cigarettes, a cigarette 20000 shown in FIG. 3 may be divided into a first portion 21000, a second portion 22000, a third portion 23000, and a fourth portion 24000. Here, at least one of the first portion 21000 and the second portion 22000 may be an aerosol-generating portion which includes at least one of an aerosol-generating material and a tobacco material.

The aerosol-generating material may include glycerin, propylene glycol, ethylene glycol, dipropylene glycol, diethylene glycol, triethylene glycol, tetraethylene glycol, and oleyl alcohol, for example, but is not limited thereto. In addition, the aerosol-generating portion may contain other additives, such as flavoring agents, wetting agents and/or organic acids. In addition, a flavored liquid, such as menthol or a moisturizer may be added to the aerosol-generating portion by spraying on the aerosol-generating portion. The aerosol-generating portion may not contain the tobacco material, and may include, for example, a corrugated sheet moistened with a moisturizer such as glycerin.

For example, the tobacco material may be formed using a tobacco sheet or tobacco strands. Also, the tobacco material may be made of shredded tobaccos which are formed of tiny bits cut from a tobacco sheet. The tobacco material may include, for example, a corrugated tobacco sheet, a crimped corrugated tobacco sheet, or a rolled tobacco sheet.

In one example, the first portion 21000 may include a corrugated sheet dampened with an aerosol-generating material, such as, for example, glycerin. Also, the second portion 22000 may include an aerosol-generating material and a tobacco material including nicotine. However, the second portion 22000 is not limited thereto. For example, the second portion 22000 may only include a tobacco material including nicotine, without an aerosol-generating material. When the second portion 22000 is heated to a proper temperature, aerosols may be generated as nicotine is vaporized.

As another example, only one of the first portion 21000 and the second portion 22000 may include an aerosol-generating material and/or a tobacco material, and the other may only serve as a front end plug or spacer (i.e., support element).

In an embodiment in which the first portion 21000 includes only the aerosol-generating material and the second portion 22000 includes only the tobacco material, when the cigarette 20000 is completely inserted into the aerosol-generating device 10000, at least a portion of each of the first portion 21000 and the second portion 22000 is located inside the aerosol-generating device 10000, and at least a portion of the third portion 23000 may be exposed outside the aerosol-generating device 10000. A user may inhale the aerosol through the fourth portion 24000. The aerosol is generated from the first portion 21000, and the generated aerosol may be transferred to the user's mouth by passing through the second portion 22000 and the third portion 23000 along the air introduced into the cigarette 20000. Since the second portion 22000 includes tobacco material, nicotine generated from the second portion 22000 may accompany the aerosol.

As an example, external air may be introduced through at least one air passage formed in the aerosol-generating device 10000. For example, the opening and closing of the air passage and/or the size of the air passage formed in the aerosol-generating device 10000 may be adjusted by the user. As such, the amount and quality of vapor may be adjusted by the user. As another example, external air may be introduced into the inside of the cigarette 20000 through at least one hole formed on a surface of the cigarette 20000.

Further, at least one of the first portion 21000 and the second portion 22000 may be surrounded by a heat-conducting material. For example, the heat-conducting material may be metal foil such as aluminum foil, but is not limited thereto. For example, the heat-conducting material surrounding at least one of the first portion 21000 and the second portion 22000 may evenly disperse heat transferred to at least one of the first portion 21000 and the second portion 22000 to improve the heat conductivity of a tobacco rod, thereby improving tobacco taste.

The third portion 23000 may be made of a polymer material or a biodegradable polymer material, and may have a cooling function. For example, the third portion 23000 may be made of pure polylactic acid alone, but is not limited thereto. For example, the third portion 23000 may be made of a cellulose acetate filter having a plurality of holes. However, the third portion 23000 is not limited to the above-described examples, and may be applicable without limitation, as long as it is capable of cooling the aerosol. For example, the third portion 23000 may be a tube filter or a paper tube including a hollow.

The fourth portion 24000 may be a cellulose acetate filter. Furthermore, the shape of the fourth portion 24000 is not limited. For example, the fourth portion 24000 may be a cylindrical type rod or a tube type rod including a hollow inside. Further, the fourth portion 24000 may be a recess type rod. If the fourth portion 24000 is composed of a plurality of segments, at least one of the plurality of segments may be manufactured in a different shape.

The fourth portion 24000 may be manufactured to produce flavor. As an example, a flavored liquid may be sprayed onto the fourth portion 24000, or a separate fiber coated with the flavored liquid may be inserted into the fourth portion 24000.

The cigarette 20000 may be wrapped by a wrapper 25000. The wrapper 25000 may have at least one hole through which external air flows in or internal gas flows out. In FIG. 3, the wrapper 25000 is shown as a single wrapper, but the wrapper 25000 may be a combination of a plurality of wrappers.

FIG. 4 is a vertical sectional view of a heating assembly 100 for an aerosol-generating device according to an embodiment.

The heating assembly 100 for an aerosol-generating device according to an embodiment may include a first heating element 110, a first electrical insulating layer 120 and a second heating element 130.

In an embodiment, the first heating element 110 may include a susceptor heated by a coil 140 positioned in the aerosol-generating device 10000. The susceptor may include a metal material. For example, the susceptor may include stainless steel, but embodiment are not limited thereto. Any other materials in which an induced current flows by the coil 140 may be used to embody the susceptor.

In an embodiment, the first electrical insulating layer 120 may be positioned to cover (i.e., overlap in a radial direction of the cigarette) at least a portion of the first heating element 110. In addition, with respect to the portion where the first electrical insulating layer 120 is positioned, the second heating element 130 may be positioned to cover at least a portion of the first electrical insulating layer 120. Since the first electrical insulating layer 120 is disposed between the first heating element 110 and the second heating element 130, the first heating element 110 and the second heating element 130 may be electrically separated.

In an embodiment, the first electrical insulating layer 120 and the second heating element 130 may be positioned to cover the entirety of the first heating element 110 along a longitudinal direction of the first heating element 110. Herein, the longitudinal direction of the first heating element 110 may be a longitudinal direction of the cigarette 20000 or a direction in which the cigarette 20000 is inserted into the aerosol-generating device such that the heating assembly 100 surrounds the cigarette 20000 accommodated in the aerosol-generating device.

In an embodiment, the first electrical insulating layer 120 may include a non-conductive ceramic material or a polymer material, for example, alumina (Al2O3), aluminum nitride (AlN), magnesium oxide (MgO), Silica, calcium carbonate (CaCO3), titanium oxide (TiO2), glass fibers, cellulose fibers, polysilicon, or polyimide. However, the first electrical insulating layer 120 is not limited thereto, and may include any suitable material for blocking electrical connection between the first heating element 110 and the second heating element 130.

In an embodiment, the second heating element 130 may include a conductive pattern 133. The conductive pattern 133 may include a conductive metal material or a semiconductor material. For example, the conductive pattern 133 may include at least one kind of gold (Au), silver (Ag), copper (Cu), lead (Pb), zinc (Zn), platinum (Pt), iron (Fe), cobalt (Co), Nickel (Ni), silicon (Si), carbon (C), and germanium (Ge). However, the conductive pattern 133 is not limited thereto, and may include any suitable material that generates heat with specific resistance when electric power is supplied thereto.

Figure 6:
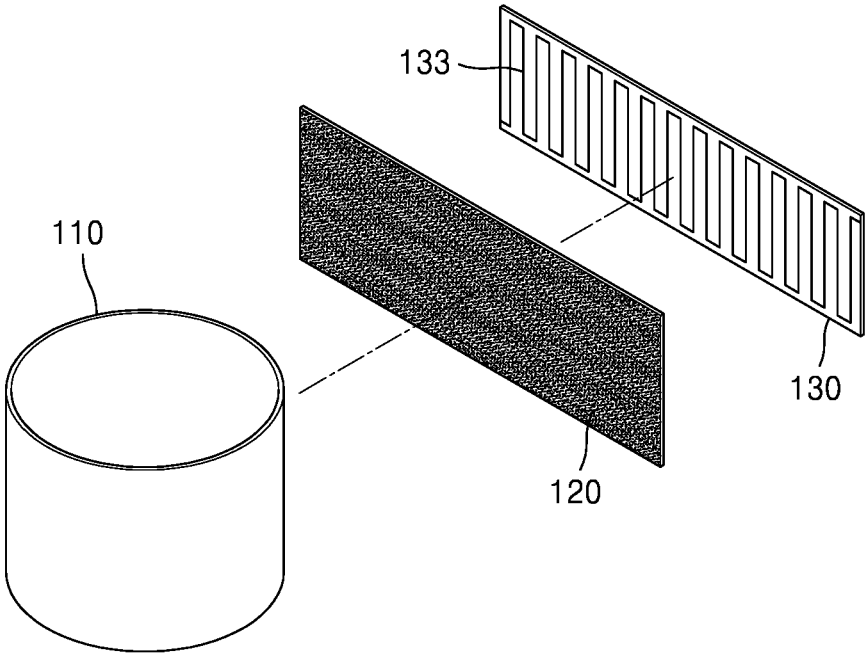
FIG. 6 is an exploded view of the heating assembly for an aerosol-generating device of the embodiment shown in FIG. 4.

The conductive pattern 133 may receive heat from outside and generate heat through its specific resistance. FIG. 6 illustrates an example of the conductive pattern 133 according to an embodiment, and a person skilled in the art may adopt and use a different pattern structure.

In order to operate the second heating element 130, power may be transmitted from a main body of the aerosol-generating device 10000 to a terminal 210 coupled to a support 200. Then, the power is transferred to the second heating element 130 through an electrode 131. The transferred power may be supplied to the conductive pattern 133, which generates thermal energy with its specific resistance.

In an embodiment, the heating assembly 100 for an aerosol-generating device may further include a second electrical insulating layer (not shown) formed on the second heating element 130. The second electrical insulating layer may include the same or different material as the first electrical insulating layer 120. When the heating assembly 100 for an aerosol-generating device further includes a second electrical insulating layer, durability of the heating assembly 100 may be improved, and electrical insulation between the heating assembly 100 and other components may be improved.

The coil 140 may receive power from the battery and generate a variable magnetic field. The first heating element 110 may be heated by a variable magnetic field, and the coil 140 may be positioned at a position where the variable magnetic field generated by the coil 140 does not affect the terminal 210 or the electrode 131. For example, the coil 140 may be positioned to surround only the first heating element 110 without surrounding the terminal 210 or the electrode 131.

The aerosol-generating device 10000 may include the support 200 that supports the heating assembly 100. The support 200 may include a terminal 210 that transfers power from the battery to the second heating element 130. In addition, the aerosol-generating device 10000 may include the electrode 131 disposed between the second heating element 130 and the terminal 210. The coil 140 may not surround the electrode 131. Accordingly, the first heating element 110 may be heated by a variable magnetic field induced by the operation of the coil 140, but the electrode 131 transferring power to the second heating element 130 may not be heated by a variable magnetic field.

The heating assembly 100 for an aerosol-generating device is not limited to the embodiment of FIG. 4. For example, the positions of the first heating element 110 and the second heating element 130 may be reversed, as explained below.

FIG. 4 shows that the second heating element 130 is positioned along the outer surface of the first heating element 110, but the second heating element 130 may be positioned along the inner surface of the first heating element 110. Accordingly, the heating assembly 100 for the aerosol-generating device may be arranged, from the inside out, in the order of the second heating element 130, the first electrical insulating layer 120, and the first heating element 110.

In this case, the heating assembly for an aerosol-generating device according to an embodiment may include a second heating element including a resistor that is heated as power is supplied; a first electrical insulating layer positioned to surround at least a portion of an outer circumferential surface of the second heating element; and a first heating element positioned on the first electrical insulating layer and including a susceptor material that is induction-heated by a variable magnetic field. Except that the positions of the first heating element 110 and the second heating element 130 are reversed, the features described herein regarding the heating assembly 100 with reference to FIG. 4 may be equally applied to this embodiment.

FIG. 5 is a vertical sectional view of a heating assembly 100 for an aerosol-generating device according to another embodiment.

According to the embodiment shown in FIG. 5, the heating assembly 100 for an aerosol-generating device has a pointed rod-like structure, unlike the cylindrical structure of FIG. 4. However, the heating elements may have similar features to those of the embodiment shown in FIG. 4, except that the pointed rod is inserted into the cigarette 20000 to heat the cigarette 20000 from the inside.

The arrangements of the coil 140 for operating the first heating element 110 and the supply of power for operating the second heating element 130 may be similar to the embodiment shown in FIG. 4. However, the arrangements of the coil 140 and the power supply for operating the second heating element 130 are not necessarily limited to thereto.

According to the embodiments shown in FIGS. 4 and 5, the heating assembly 100 for the aerosol-generating device may include both the first heating element 110 and the second heating element 130. The heating assembly 100 may control a specific heating element to be operated in a specific mode, thereby improving the heating efficiency of the cigarette 20000 and reducing power consumption of the aerosol-generating device 10000.

In detail, when the first electrical insulating layer 120 and the second heating element 130 are positioned to overlap the entirety of the first heating element 110, the first heating element 110 and the second heating element 130 may be heated together or only one of the first heating element 110 and the second heating element 130 may be heated.

The first heating element 110 and the second heating element 130 may be controlled independently of each other by the controller 12000, as will be described later. In a preheating mode of the aerosol-generating device 10000, the first heating element 110 and the second heating element 130 are operated together, and in a smoking mode of the aerosol-generating device 10000, only one of the first heating element 110 and the second heating element 130 may be operated.

Accordingly, the time for the cigarette 20000 to reach a preset temperature in the preheating mode of the aerosol-generating device 10000 may be shorter than the time for the cigarette 20000 to reach the preset temperature in the smoking mode of the aerosol-generating device 10000. In addition, by controlling the type and number of heating elements to be operated in each mode, power consumption of the aerosol-generating device 10000 may be reduced.

The preset temperature may be within an appropriate temperature range for generating an aerosol without burning the cigarette 20000. The preset temperature may be, for example, about 180° C. to about 300° C., preferably about 230° C. to about 260° C. However, the preset temperature is not necessarily limited thereto.

FIG. 6 is an exploded view of a heating assembly 100 for an aerosol-generating device of the embodiment shown in FIG. 4.

The first heating element 110 may have a cylindrical structure. As shown in FIG. 4, a cigarette 20000 may be inserted into the first heating element 110. Accordingly, the cigarette 20000 may be heated by the first heating element 110 from the outside of the cigarette 20000.

The first electrical insulating layer 120 may include an electrical insulating material, and may be positioned to surround the outer surface of the cylindrical structure of the first heating element 110.

The second heating element 130 may include a conductive pattern 133. The conductive pattern 133 has specific resistance, and when power is supplied, heat may be generated by the specific resistance. The second heating element 130 including the conductive pattern 133 may be positioned to surround the cylindrical structure of the first heating element 110 over the first electrical insulating layer 120. In FIG. 6, the second heating element 130 includes a support structure for supporting the conductive pattern 133, but the second heating element 130 may be composed of only the conductive pattern 133 printed on the first electrical insulating layer 120.

Figure 7:
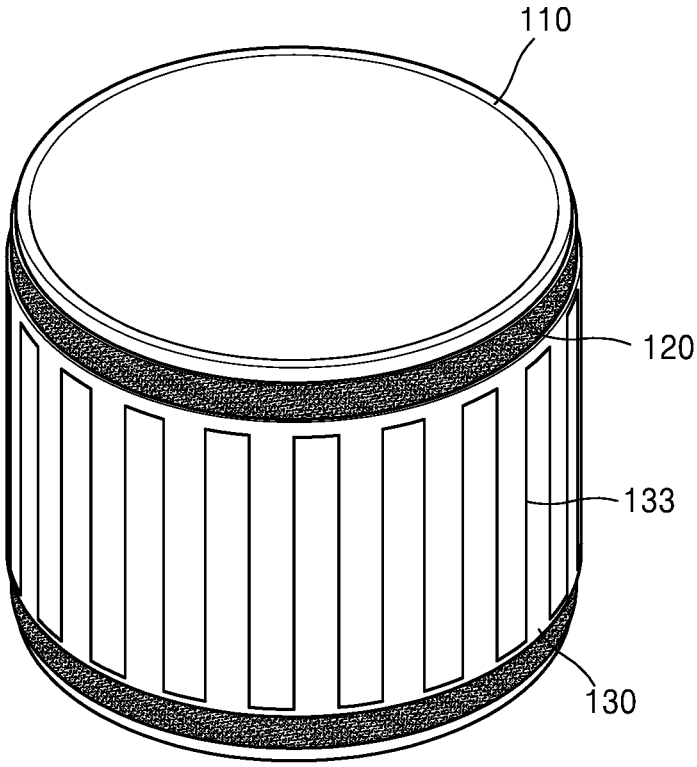
FIG. 7 is a combined view of the heating assembly for an aerosol-generating device of the embodiment shown in FIG. 4.

FIG. 7 is a combined view of a heating assembly 100 for an aerosol-generating device of the embodiment shown in FIG. 4.

From the inside out, the heating assembly 100 may include the first heating element 110, the first electrical insulating layer 120, and the second heating element 130 may be arranged in sequence. The cigarette 20000 may be inserted into the aerosol-generating device 10000. As described above, for example, when the aerosol-generating device 10000 is in the preheating mode, both the first heating element 110 and the second heating element 130 may be operated, so that the cigarette 20000 is quickly heated. By contrast, when the aerosol-generating device 10000 is in a smoking mode, only one of the first heating element 110 and the second heating element 130 may be operated, so power consumption for maintaining the temperature of the cigarette 20000 may be reduced.

In this case, heat generated in the conductive pattern 133 of the second heating element 130 may be transferred to the cigarette 20000 through the first electrical insulating layer 120 and the first heating element 110. Also, the first heating element 110 generates heat according to a variable magnetic field generated by the coil 140, and the generated heat may be transferred to the cigarette 20000.

Figure 8:
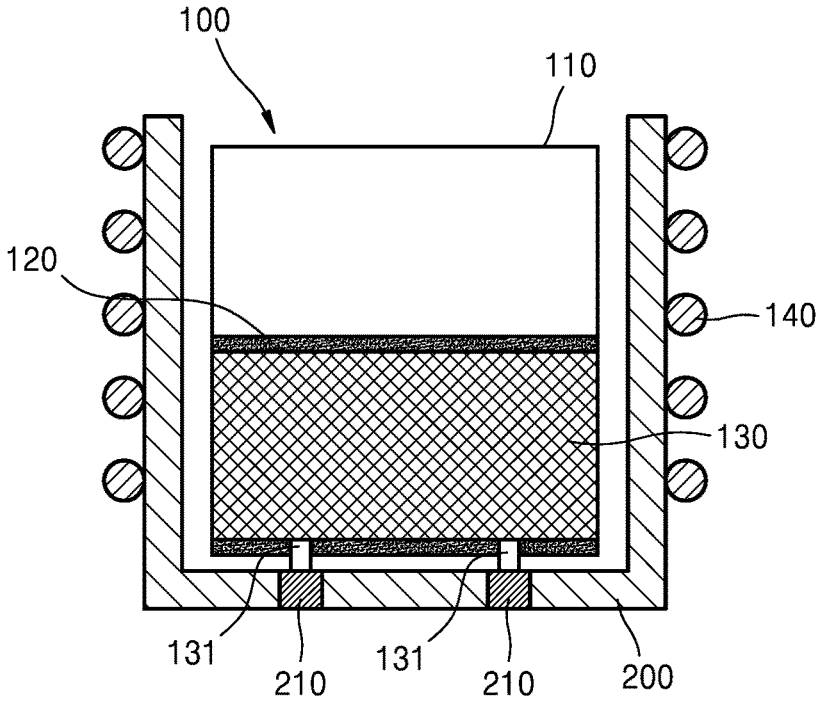
FIG. 8 is a cross-sectional view showing an example of a heating assembly in which a first electrical insulating layer and a second heating element are positioned to cover a portion of a first heating element.

FIG. 8 is a vertical cross-sectional view of a heating assembly 100 for an aerosol-generating device according to an embodiment in which the first electrical insulating layer 120 and the second heating element 130 are positioned to cover a portion of the first heating element 110 of a cylindrical shape.

In an embodiment, the first electrical insulating layer 120 and the second heating element 130 may be positioned to cover a portion of the first heating element 110 along the longitudinal direction of the first heating element 110. Here, the longitudinal direction of the first heating element 110 may be a longitudinal direction of the cigarette 20000 or a direction in which the cigarette 20000 is inserted into the aerosol-generating device such that the heating assembly 100 surrounds the cigarette 2000.

In one example, the cigarette 20000 inserted into the aerosol-generating device may include two aerosol-generating portions, and each of the first portion 21000 and the second portion 22000 may correspond to a separate aerosol-generating portion. The first portion 21000 may include only an aerosol-generating material without a tobacco material, and the second portion 22000 may include the tobacco material. The first portion 21000 may be positioned at a distal end of the cigarette 20000. For example, the first portion 21000 may be 8 mm to 12 mm in length in the longitudinal direction of the cigarette 20000.

The first heating element 110 may heat the first portion 21000 and the second portion 22000 of the cigarette 20000, and the second heating element 130 may heat the first portion 21000 or the second portion 22000 of the cigarette 20000. For example, the second heating element 130 may heat the first portion 21000 of the cigarette 20000.

For example, the second heating element 130 may be positioned to surround 8 mm to 12 mm of the distal area of the inserted cigarette 20000, which corresponds to the first portion 21000.

Since the second heating element 130 is positioned to cover only the first portion 21000, the first portion 21000 of the cigarette 20000 may be intensively heated. Accordingly, a sufficient amount of aerosol may be generated in the first portion 21000 which only includes an aerosol-generating material that requires a relatively high heating temperature for vaporization. For example, propylene glycol, glycerin, and the like included in the first portion 21000 of the cigarette 20000 may be vaporized within seconds to tens of seconds after the operation of the first heating element 110 and the second heating element 130.

In an embodiment, the aerosol-generating device may appropriately select a type and number of heating elements to be operated in each operating mode.

For example, when the aerosol-generating device is in the preheating mode, a controller may control a battery to supply power to the second heating element and the coil, thereby heating the first heating element and the second heating element. In addition, when the aerosol-generating device is in the smoking mode, the controller may control the battery to supply power to either the coil or the second heating element, thereby heating either the first heating element or the second heating element.

Figure 9:
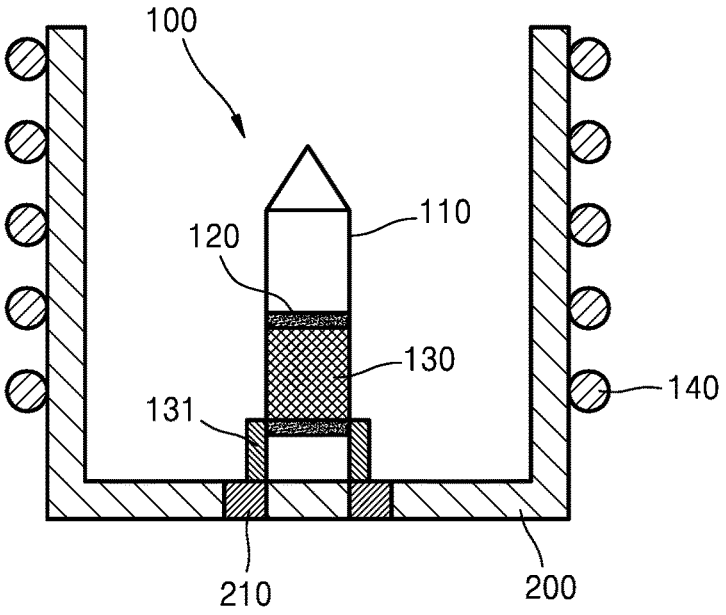
FIG. 9 is a cross-sectional view showing another example of a heating assembly in which a first electrical insulating layer and a second heating element are positioned to cover a portion of a first heating element.

FIG. 9 is a vertical cross-sectional view of a heating assembly 100 for an aerosol-generating device according to an embodiment in which a second heating element 130 is positioned to cover a portion of a first heating element 110.

The embodiment of FIG. 9 may be the same as the embodiment shown in FIG. 8, except that a shape of the heating assembly 100 for an aerosol-generating device is a pointed rod-shaped.

Figure 10:
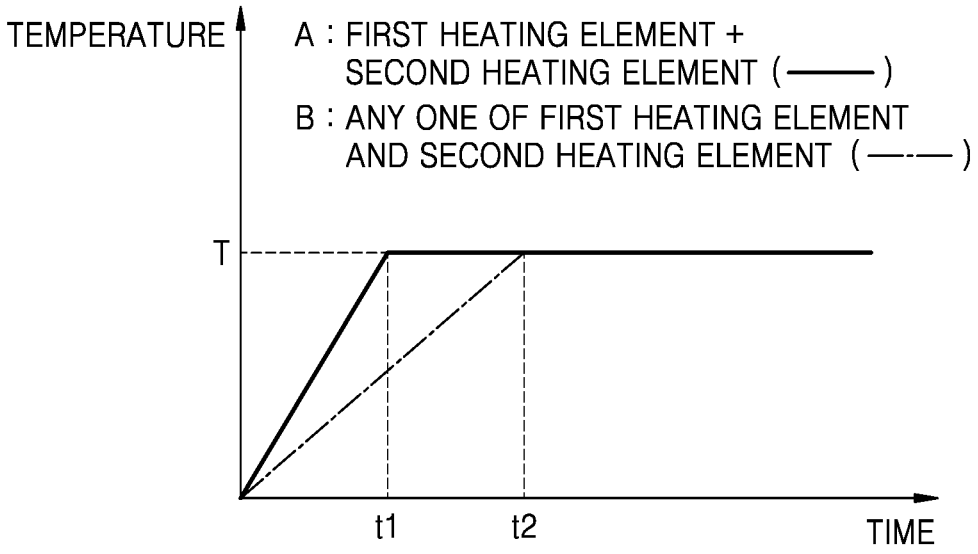
FIG. 10 is a graph showing a heating temperature of the aerosol-generating device in a case where both a first heating element and a second heating element are operating and a case where only one of the first heating element and the second heating element is operating, according to an embodiment.

FIG. 10 is a graph showing a heating temperature of the aerosol-generating device in a case (A) where both the first heating element 110 and the second heating element 130 are operating and a case (B) where only one of the first heating element 110 and the second heating element 130 is operating, according to an embodiment.

The temperature reaches the specific temperature T at time t1 in the case (A) where both the first heating element 110 and the second heating element 130 are operated, while the temperature reaches the specific temperature T at time t2 in the case (B) where only one of the first heating element 110 and the second heating element 130 is operated. That is, when both heating elements are operated in a preheating mode of the aerosol-generating device, the time to reach a specific preheating temperature may be shortened. On the other hand, when only one heating element is operated in a smoking mode, power consumed in the aerosol-generating device 10000 may be reduced.

In addition, in an embodiment where both the first heating element 110 and the second heating element 130 are operated to heat a portion of the cigarette 20000, for example, the first portion 21000, heat may be more concentrated compared with another portion heated by one of the first heating element 110 and the second heating element 130. As a result, aerosols may be generated quickly and sufficiently.

The controller 12000 may control power supplied from the battery to the coil 140 and power supplied to the second heating element 130 independently of each other. For example, as in the embodiment of FIG. 4, when the first electrical insulating layer 120 and the second heating element 130 cover the entirety of the first heating element 110, the controller 12000 may control the first heating element 110 and the second heating element 130 to be heated independently of each other. Accordingly, the cigarette 20000 may reach a preset temperature in the preheating mode faster than in the smoking mode of the aerosol-generating device 10000. In addition, by controlling the type and number of heating elements to be operated in each operating mode, power consumption of the aerosol-generating device 10000 may be reduced.

The above-described features of the heating assembly 100 for an aerosol-generating device may be applied to an aerosol-generating device 10000 and an aerosol-generating system, and omission of description regarding the application does not exclude the application of the above features.

At least one of the components, elements, modules or units (collectively "components" in this paragraph) represented by a block in the drawings such as the controller 12000 in FIGS. 1 and 2, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

What is claimed is:

1. A heating assembly for an aerosol-generating device, the heating assembly comprising:

a first heating element including a susceptor material configured to be heated by induction heating according to a variable magnetic field;

a first electrical insulating layer that surrounds at least a portion of an outer surface of the first heating element;

a second heating element, an entire surface of the second heating element surrounding at least a portion of an outer surface of the first electrical insulating layer and being configured to be heated by specific resistance as power is supplied; and a coil configured to induce the variable magnetic field to heat the first heating element, the coil being separate from the second heating element, wherein the first heating element and the second heating element are electrically separated through the first electrical insulating layer.

2. The heating assembly of claim 1, wherein the second heating element includes a conductive pattern, and the heating assembly further comprises a second electrical insulating layer positioned on the conductive pattern.

3. The heating assembly of claim 1, wherein the first electrical insulating layer and the second heating element fully cover the first heating element along a longitudinal direction of the first heating element, and the longitudinal direction of the first heating element is a longitudinal direction of a cigarette or a direction in which the cigarette is inserted into the aerosol-generating device.

4. The heating assembly of claim 1, wherein the first electrical insulating layer and the second heating element partially cover the first heating element along a longitudinal direction of the first heating element, and the longitudinal direction of the first heating element is a longitudinal direction of a cigarette or a direction in which the cigarette is inserted into the aerosol-generating device.

5. The heating assembly of claim 1, wherein a cigarette to be inserted in the aerosol-generating device includes a first portion and a second portion which generate an aerosol when heated, the first heating element overlaps the first portion and the second portion of the cigarette in a radial direction of the cigarette, and the second heating element overlaps the first portion or the second portion of the cigarette in the radial direction of the cigarette.

6. The heating assembly of claim 1, wherein a cigarette to be inserted in the aerosol-generating device includes a first portion and a second portion which generate an aerosol when heated, and the first heating element overlaps the first portion and the second portion of the cigarette in a radial direction of the cigarette, and the second heating element overlaps the first portion of the cigarette in the radial direction of the cigarette.

7. An aerosol-generating device comprising:

the heating assembly according to claim 1;

a battery configured to supply power to the coil and the second heating element; and a controller configured to control the power supplied by the battery to the coil and the second heating element.

8. The aerosol-generating device of claim 7, further comprising:

a support that supports the heating assembly and comprises a terminal configured to transmit the power from the battery to the second heating element; and an electrode positioned between the second heating element and the terminal, wherein the coil overlaps the first heating element and does not overlap the electrode, in a radial direction of the cigarette.

9. The aerosol-generating device of claim 7, wherein when the aerosol-generating device is in a preheating mode, the controller controls the battery to supply power to the second heating element and the coil such that the first heating element and the second heating element are heated, and when the aerosol-generating device is in a smoking mode, the controller controls the battery to supply power to the coil or the second heating element such that only one of the first heating element and the second heating element is heated.

10. An aerosol-generating system comprising:

a cigarette including a first portion and a second portion which generate an aerosol when heated; and an aerosol-generating device including a heating assembly configured to heat the cigarette, wherein the heating assembly comprises:

a first heating element including a susceptor material configured to be heated by induction heating according to a variable magnetic field;

a first electrical insulating layer that surrounds at least a portion of an outer surface of the first heating element;

a second heating element, an entire surface of the second heating element surrounding at least a portion of an outer surface of the first electrical insulating layer and being configured to be heated by specific resistance as power is supplied; and a coil configured to induce the variable magnetic field to heat the first heating element, the coil being separate from the second heating element, wherein the first heating element and the second heating element are electrically separated through the first electrical insulating layer.

11. The aerosol-generating system of claim 10, wherein, when the cigarette is inserted into the aerosol-generating device, the first heating element overlaps the first portion and the second portion of the cigarette in a radial direction of the cigarette, and the second heating element overlaps the first portion of the cigarette in the radial direction of the cigarette.

12. The aerosol-generating system of claim 10, wherein the aerosol-generating device further includes:

a battery configured to supply power to the heating assembly; and a controller configured to:

when the aerosol-generating device is in a preheating mode, control the battery to supply power to the second heating element and the coil such that the first heating element and the second heating element are heated, and when the aerosol-generating device is in a smoking mode, the controller controls the battery to supply power to the coil or the second heating element such that only one of the first heating element and the second heating element is heated.

* * * * *